United States Patent [19]

Zusman

[11] 4,194,326

[45] Mar. 25, 1980

[54] PEDESTAL HOUSE WITH CANTILEVERED CROSS TRUSS CONSTRUCTION

[76] Inventor: Bertram Zusman, 4112 Montecello Blvd., Youngstown, Ohio 44505

[21] Appl. No.: 955,124

[22] Filed: Oct. 26, 1978

[51] Int. Cl.[2] ..... F04B 1/34

[52] U.S. Cl. ..... 52/73; 52/668; 52/693

[58] Field of Search ..... 52/73, 667, 668, 643, 52/693, 690, 648

[56] References Cited

U.S. PATENT DOCUMENTS

| | | | |
|---|---|---|---|
| 1,911,018 | 5/1933 | Goeltz | 52/648 |
| 2,345,500 | 3/1944 | Petter | 52/73 |
| 3,408,777 | 11/1968 | Ghirelli | 52/73 X |
| 3,633,325 | 1/1972 | Bartoli | 52/73 |
| 3,645,052 | 2/1972 | Hanna | 52/73 X |
| 3,755,973 | 9/1973 | Rader | 52/73 |
| 4,106,258 | 8/1978 | Lindsay | 52/643 X |

OTHER PUBLICATIONS

*Trus Joist Design Manual,* 1973, p. D-9.

*Primary Examiner*—James A. Leppink
*Assistant Examiner*—Carl D. Friedman
*Attorney, Agent, or Firm*—Webster B. Harpman

[57] ABSTRACT

A pedestal house with a cantilevered crossed truss construction forming the floor and wall supporting structure thereof has several pairs of crossed horizontally disposed truss members, each truss member has vertically spaced top and bottom cord members and interconnecting web members, one of each pair of truss members being of a greater height than the other so that one truss member of each pair passes through an opening in the other at right angles thereto. Members are located longitudinally of said other truss member of each pair so as to increase the height thereof to that of the higher truss member of the pair. This invention is distinguishable from others by reason of the pedestal house and the crossed truss members thereof forming a central area from which the ends of the truss members extend in cantilever form to form a wide stable support structure for the house on the pedestal.

5 Claims, 4 Drawing Figures

PEDESTAL HOUSE WITH CANTILEVERED CROSS TRUSS CONSTRUCTION

BACKGROUND OF THE INVENTION (1) Field of the Invention

This invention relates to pedestal houses incorporating supporting structures of a truss configuration in a cantilever design.

(2) Description of the Prior Art

No prior structures of this type are known. Truss constructions for load supporting assemblies have been used but not as integral parts of a pedestal house.

In the present invention a pedestal house is disclosed with a crossed truss construction built integrally therewith, the crossed truss construction includes several spaced truss members with uninterrupted upper and lower cords with the trusses placed at right angles through one another to achieve a self-supporting cantilevered structure in a cross shape.

SUMMARY OF THE INVENTION

A pedestal house has an integral cantilevered crossed truss construction wherein a series of pairs of two different sized truss members are placed at right angles, one truss of each pair passing through the other, forming a spaced self-supporting crossed truss construction and floor support whose ends are cantilevered to extend past the foundation walls of the house. The crossed truss members are preferably made of wood.

DESCRIPTION OF THE PREFERRED EMBODIMENT

Figure 1:
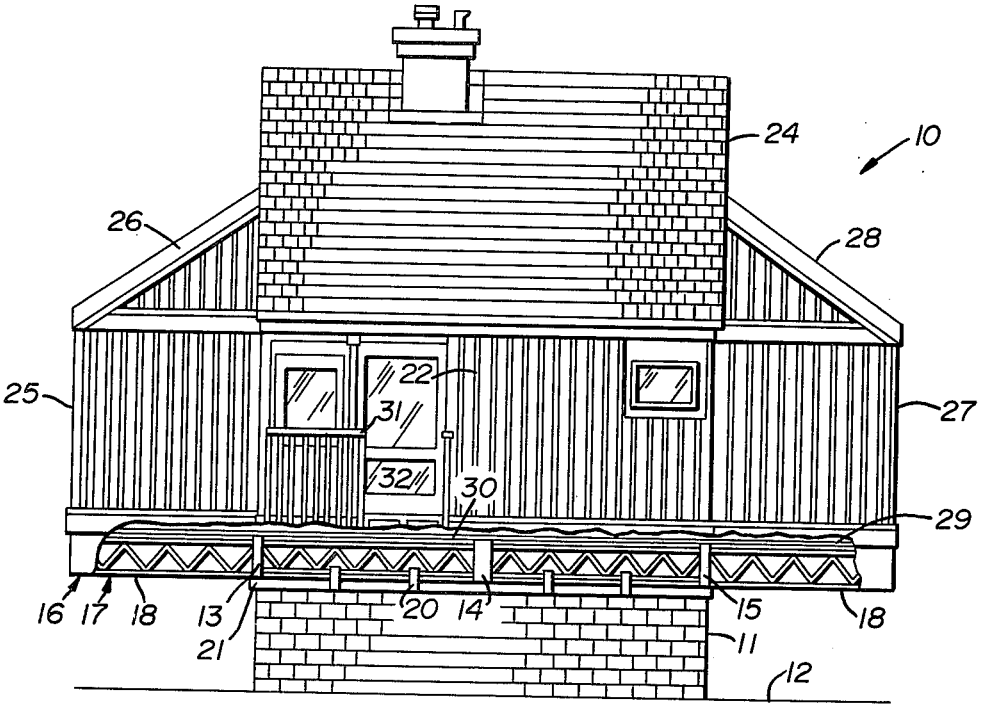
FIG. 1 is a front plan view of the pedestal house.
Figure 2:
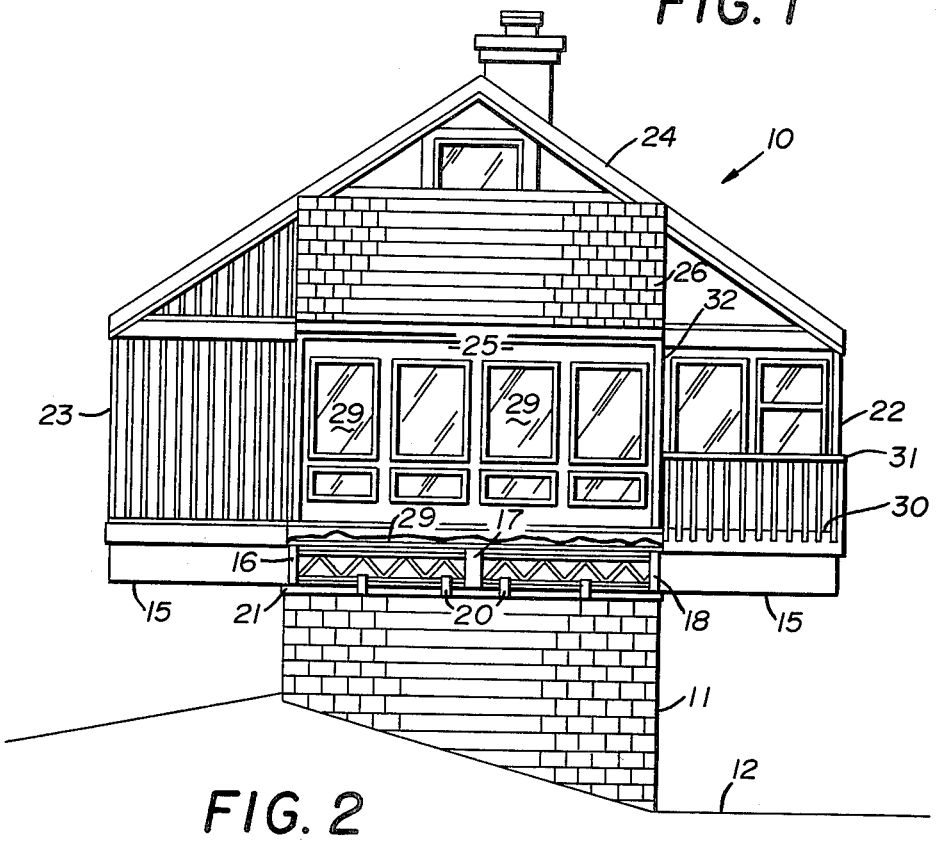
FIG. 2 is a side plan view thereof.

By referring to FIGS. 1 and 2 of the drawings, a pedestal house 10 may be seen positioned on a square pedestal foundation 11 extending above a ground line 12. A cantilevered cross truss construction is shown as an integral part of the house and comprises multiple truss members 13, 14, and 15 and 17, 18 and 19 respectively. A plurality of tie down straps 20 join the truss members to a plate 21 on the foundation wall 11.

In FIGS. 1 and 2 of the drawings, the house will be seen to comprise a rectangular structure having a front wall 22 and a back wall 23 and a pitched roof 24 extending thereover. The width of the front and back walls 22 and 23 is substantially the same as the foundation 11 and the front and back walls 22 and 23 are spaced with respect to one another a distance substantially double that of the dimension of the foundation 11. Thus the house extends between the front and back walls 22 and 23 in a rectangular configuration, all of which is covered by the pitched roof 24 and its two inclined sections joined at the ridge.

By referring to FIG. 1 of the drawings it will be seen that the cantilevered ends of the truss members 16, 17 and 18 extend sidewardly with respect to the pedestal foundation 11 and the rectangular body of the house heretofore described. On the left of FIG. 1 the extension has an outermost wall 25 and a shed roof 26 thereover and on the right of FIG. 1 the extension has an outermost wall 27 with a shed roof 28 thereover.

In FIG. 2 of the drawings it will be seen that the outermost wall 25 is largely formed of a plurality of windows 29.

The floor and house support structure are thereby formed of the crossed trusses 13, 14 and 15 running in one direction and the trusses 16, 17 and 18 running at right angles thereto and it will be seen that these trusses form the floor joists and that the subfloor and finished floor are positioned directly thereon as indicated at 29 in FIGS. 1 and 2 of the drawings. The vertical walls 22, 23, 25 and 27 are positioned on the cantilevered ends of the crossed trusses, preferably after the subfloor 29 has been installed and the same is true of the interiorpartitions as will occur to those skilled in the art.

By referring to FIGS. 1 and 2 of the drawings, it will be seen that there is an entrance area 30 which is also positioned on the cantilevered ends of the trusses 13, 14 and 15 and provided with a partially enclosing railing 31. An entrance door 32 is positioned in recessed relation to the front wall 22.

It will occur to those skilled in the art that the actual configuration of the pedestal house can vary from that illustrated herein as an example and that the utilization of the crossed truss members 13–15 and 16–18 form an extremely sturdy and practical floor joist construction in the pedestal house as well as enabling the cantilevered portions thereof to be extended beyond the pedestal foundation 11 in a non-sagging manner.

Figure 3:
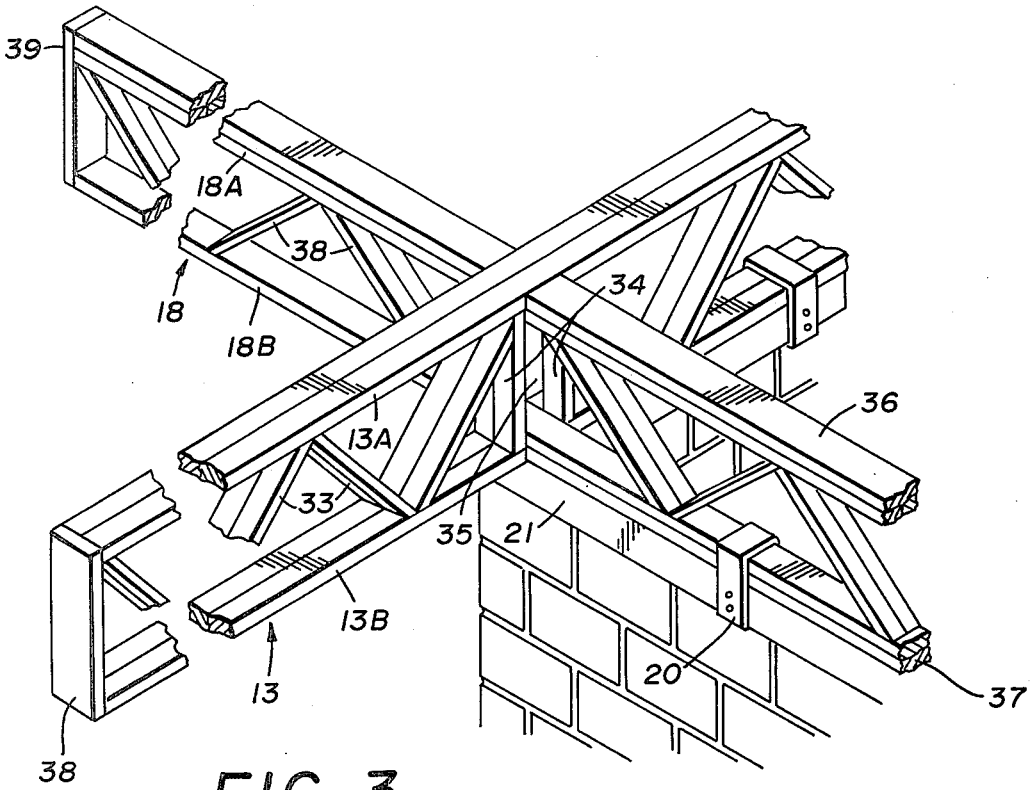
FIG. 3 is an enlarged perspective view of a portion of the crossed truss construction with parts broken away used as the floor and wall support of the pedestal house.

By referring now to FIG. 3 of the drawings, one of the corners of the crossed truss construction that forms a part of the pedestal house herein disclosed may be seen in enlarged detail and with parts broken away. In FIG. 3 of the drawings, the truss 13, which is also seen in FIG. 1 of the drawings, will be found to comprise upper and lower chords 13A and 13B with angularly disposed interconnecting webs 33 therebetween. A pair of vertical web members 34 are spaced with respect to one another to form an opening 35 through which the truss 18 is positioned and its upper and lower chords are indicated at 18A and 18B and it is provided with a pair of spacer members 36 and 37 on the upper and lower chords 18A and 18B so as to bring its height to match that of the truss 13. The truss member 18 has angularly positioned interconnecting web members 38 which extend continuously between the upper and lower chord members 18A and 18B respectively, and the ends of the trusses 13 and 18 are capped by end caps 38 and 39 respectively.

Figure 4:
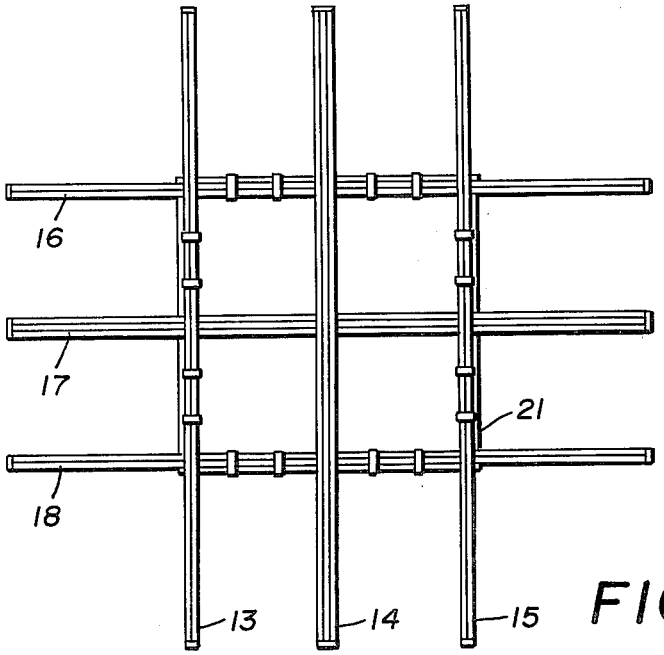
FIG. 4 is a top plan view of the cantilevered crossed truss construction used in the pedestal house.

By referring to FIG. 4 of the drawings, it will be seen that in the preferred embodiment the truss 13 and the truss 15 are formed of side by side two by four wooden members while the truss 14 is formed of three such members and the same is true of the trusses 16 and 18 as they are formed of side by side two by four members while the truss 17 intermediate the same is formed of three two by four members. Obviously one or more of the two by four members may be used to form each truss or alternately they may be formed of larger sized wooden members.

Still referring to FIG. 4 of the drawings, it will be observed that the trusses 13, 14 and 15 are the ones that have the vertical openings such as 35 in the truss 13 as seen in FIG. 3 and that the trusses 16, 17 and 18 are of the smaller vertical height and pass through the vertical openings in each of the trusses 13, 14 and 15. The resulting construction is unusually rigid and provides an unusual and highly efficient cantilevered projecting support for the pedestal house and its front and back and sideward extensions, all as heretofore described.

The above described structure and specifically the crossed truss construction becomes a part of the pedestal house by replacing the customary floor joists and provides all of the advantage hereinbefore mentioned.

Although but one embodiment of the present invention has been illustrated and described, it will be apparent to those skilled in the art that various changes and modifications may be made therein without departing from the spirit of the invention, and having thus described my invention what I claim is:

1. A pedestal house comprising an enclosure having a floor supporting structure and a foundation thereunder, said floor supporting structure consisting of a cantilevered crossed truss construction comprising several pairs of crossed horizontally disposed truss members, each member including vertically spaced top and bottom chord members and interconnecting web members, one of each pair of truss members being of a greater height than the other so that one truss member of each pair passes through an opening in the other, spacing members longitudinally of said other truss members so as to increase the height thereof to that of said higher truss members, a floor in said enclosure disposed on said crossed truss construction and outer and inner walls forming said enclosure positioned on said crossed truss construction and wherein the ends of said crossed trusses extend beyond said foundation to form cantilevered extensions supporting portions of said enclosure thereabove.

2. The pedestal house of claim 1 and wherein the crossed truss members are made of several individual trusses secured to one another in side by side relation.

3. The pedestal house of claim 1 and wherein the cantilevered crossed truss construction has most of said interconnecting web members angularly disposed between the top and bottom chord members and wherein several of said web members are arranged in horizontally spaced, vertically standing pairs to form said openings.

4. The pedestal house of claim 1 and wherein said spacing members are positioned on the upper and lower surfaces of said other truss members and in addition to extending the height thereof provide reinforcement thereto.

5. A pedestal house comprising an enclosure having a floor and supporting structure and a foundation thereunder, said floor and supporting structure consisting of a cantilevered crossed truss construction comprising several horizontally disposed truss members of a known height arranged in spaced parallel relation to one another and several horizontally disposed spaced parallel truss members of a lesser height than said first mentioned truss members arranged at right angles thereto, each of said truss members having vertically spaced top and bottom chord members and interconnecting web members, said truss members of lesser height positioned through openings in the first mentioned truss members, spacing members longitudinally of said truss members of lesser height so as to increase the height thereof to that of said first mentioned truss members, a floor in said enclosure positioned on and secured to said crossed truss construction and outer and inner walls forming said enclosure positioned on said crossed truss construction and floor and wherein the ends of said crossed trusses extend beyond said foundation to form cantilevered extensions supporting portions of said enclosure thereabove.

* * * * *